US008629339B1

(12) United States Patent
Liao

(10) Patent No.: US 8,629,339 B1
(45) Date of Patent: Jan. 14, 2014

(54) PORTABLE PRACTICE INSTRUMENT

(71) Applicant: Tsun-Chi Liao, Taichung (TW)

(72) Inventor: Tsun-Chi Liao, Taichung (TW)

( * ) Notice: Subject to any disclaimer, the term of this patent is extended or adjusted under 35 U.S.C. 154(b) by 0 days.

(21) Appl. No.: 13/740,977

(22) Filed: Jan. 14, 2013

(51) Int. Cl.
*G10D 13/02* (2006.01)

(52) U.S. Cl.
USPC ..... 84/411 P

(58) Field of Classification Search
USPC ..... 84/411 R, 411 P
See application file for complete search history.

(56) References Cited

U.S. PATENT DOCUMENTS 4,406,207 A * 9/1983 Criscione ..... 84/411 P

* cited by examiner

*Primary Examiner* — Kimberly Lockett

(74) *Attorney, Agent, or Firm* — Muncy, Geissler, Olds & Lowe, PLLC

(57) ABSTRACT

A portable practice instrument comprises a hitting pad, a fastening band, a holding board and two support pads. The hitting pad is located on the holding board. The two support pads are located below the holding board to form a housing groove therebetween. The holding board has a first threading slot and a second threading slot at two opposite ends outside the hitting pad. The fastening band threads through the first threading slot and the second threading slot via the housing groove. Thus a dual-purpose practice instrument is formed, which not only can be easily carried by users, but also can be selectively wrapped on a user's thigh through the fastening band or laid stably on a desktop through the two support pads with the fastening band threading through the housing groove for hitting practice according to onsite environment, thereby meets use requirements.

5 Claims, 6 Drawing Sheets

PORTABLE PRACTICE INSTRUMENT

FIELD OF THE INVENTION

The present invention relates to a practice instrument and particularly to a portable and dual-purpose practice instrument.

BACKGROUND OF THE INVENTION

Drummer plays an important role in the performance of a music band. The drummer provides rhythm during hitting to give tempo in a musical performance that directly affects the acting of the music. The rhythm of the drummer, aside from the innate talent, has to be acquired through long-term and persistent practice. As the musical instruments required by the drummer occupy substantial space and the sound generated also is quite loud, they would hardly be installed in an ordinary home environment.

In order to meet drummer's practice requirement, a practice instrument has been developed and marketed as shown in FIG. 1. It comprises a hitting pad 1, a holding rack 2 and a wrapping band 3. The hitting pad 1 is mounted onto the holding rack 2 and can generate a deep and low sound that is not too loud to disturb people. The holding rack 2 has a curved contact surface 4 to be rested on a user's thigh 6. The wrapping band 3 has a Velcro 5 with one end fastened to the holding rack 2 and another end bonded to wrap the user's thigh 6 so that the holding rack 2 can be securely held on the user's thigh 6. Thereby the user can beat the hitting pad 1 for practice as desired.

However, the conventional practice instrument mentioned above is formed in a cubical shape and not easy to be carried around. Moreover, it can be held merely on a user's thigh 6. Furthermore, because of the wrapping band 3, it cannot be placed on a desktop for use. All these cannot meet use requirement.

SUMMARY OF THE INVENTION

The primary object of the present invention is to provide a portable and dual-purpose practice instrument that can be carried around easily to meet use requirements.

To achieve the foregoing object, the portable practice instrument of the invention comprises a hitting pad, a holding board, two support pads and a fastening band. The hitting pad is located on the holding board. The holding board has a first threading slot and a second threading slot at two opposite ends outside the hitting pad. The two support pads are located below the holding board to form a housing groove therebetween. The fastening band threads through the first threading slot and the second threading slot via the housing groove.

By means of the structure set forth above, a user can select to wrap the fastening band on his/her thigh, or thread the fastening band through the housing groove and place the two support pads stably on a desktop to do hitting practice. Thus a dual-purpose practice instrument is formed. Moreover, as the practice instrument is formed in a flat shape, it can be carried around easily by the user, thereby meets use requirements.

The foregoing, as well as additional objects, features and advantages of the invention will be more readily apparent from the following detailed description, which proceeds with reference to the accompanying embodiment and drawings. The embodiment serves merely for illustrative purpose and is not the limitation of the invention.

DETAILED DESCRIPTION OF THE PREFERRED EMBODIMENT

Figure 1:
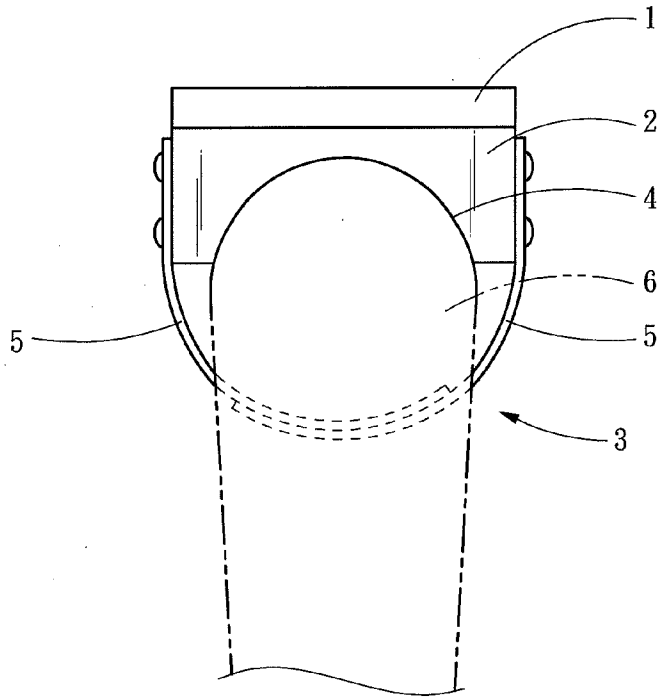
Fig. 1 PRIOR ART
FIG. 1 is a schematic view of a conventional practice instrument.
Figure 2:
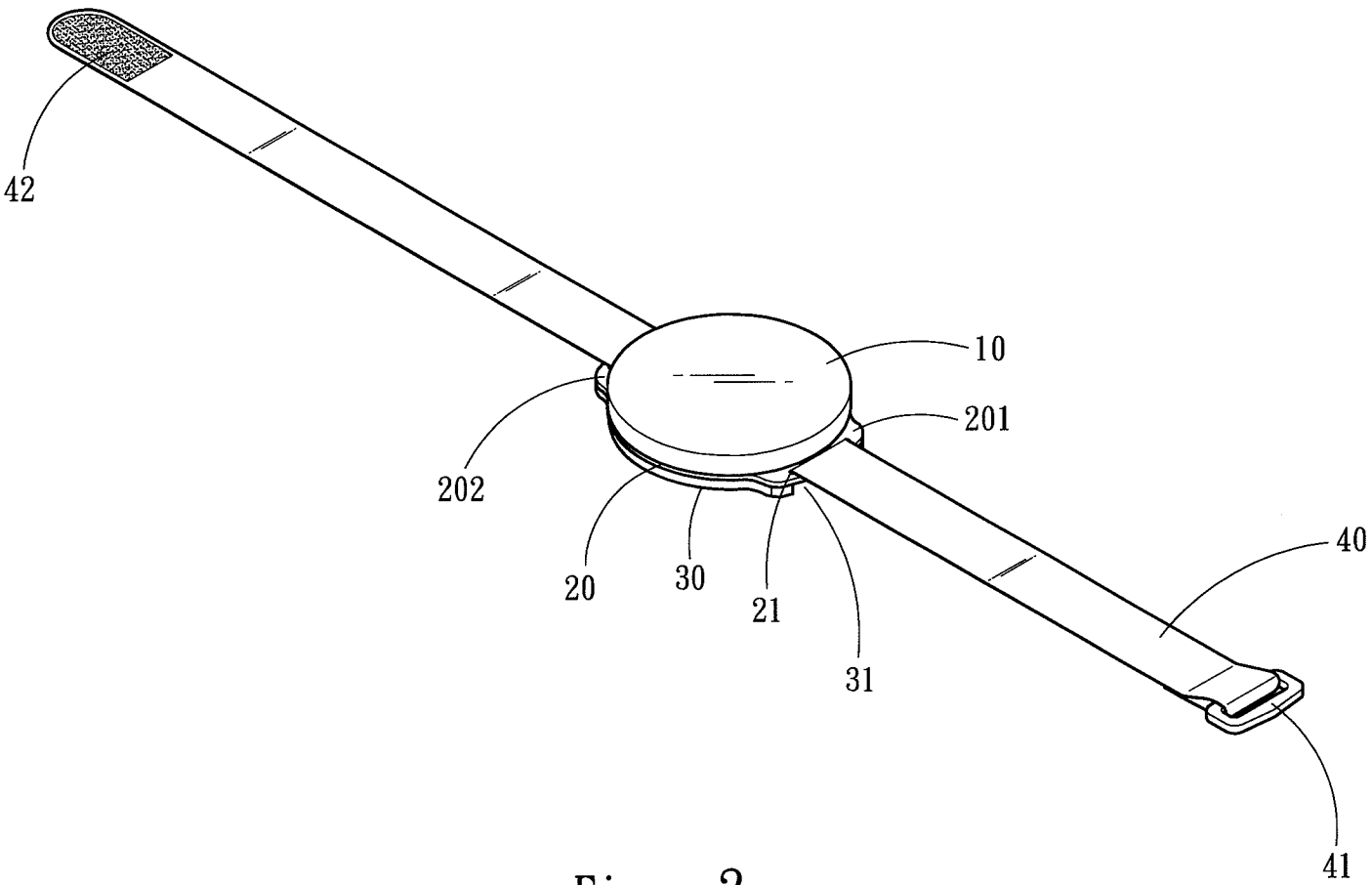
FIG. 2 is a perspective view of the invention.
Figure 3:
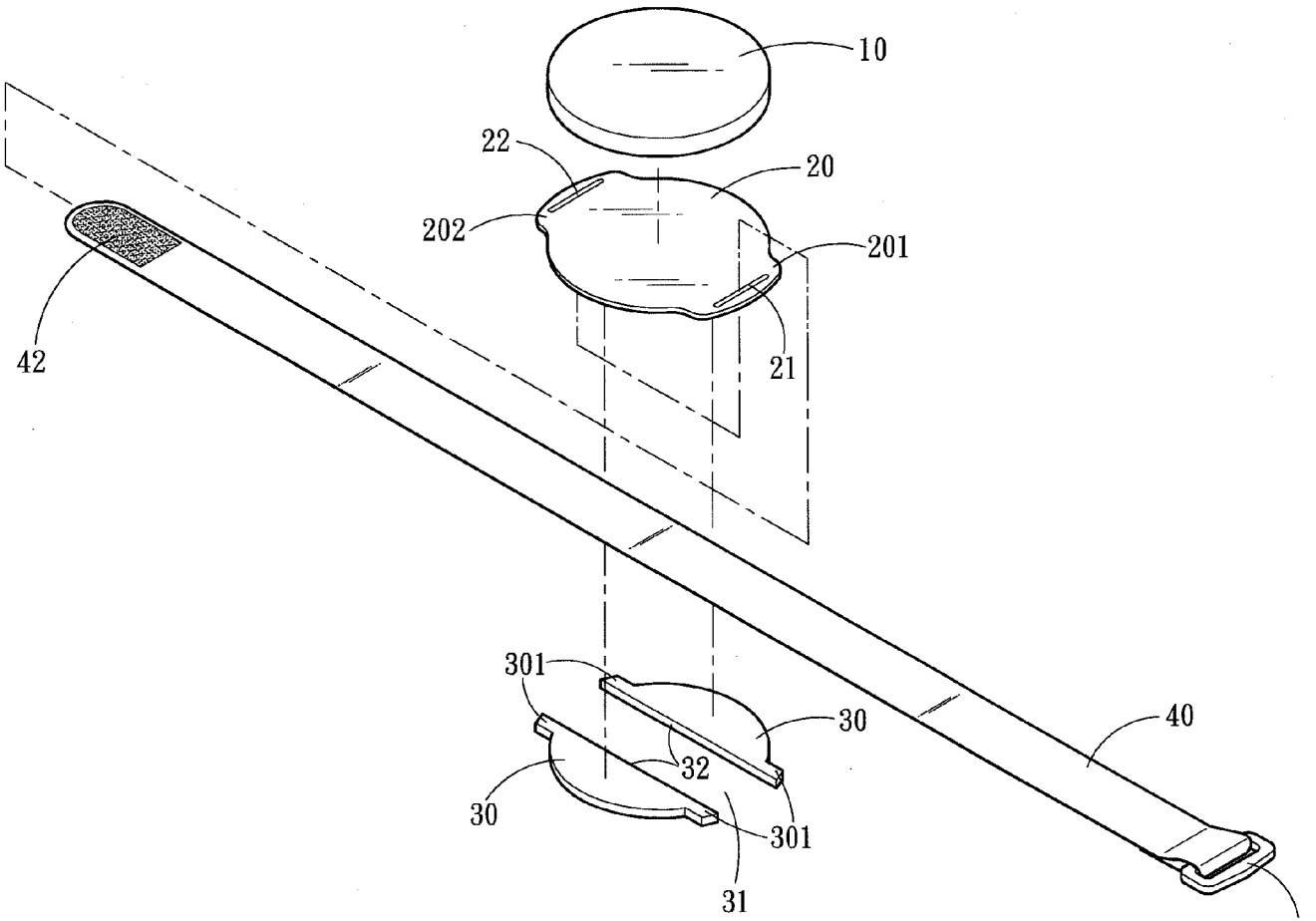
FIG. 3 is an exploded view of the invention.

Please refer to FIGS. 2 and 3, the present invention aims to provide a portable practice instrument that comprises a hitting pad 10, a holding board 20, two support pads 30 and a fastening band 40. The hitting pad 10 is located on the holding board 20. The holding board 20 has a first threading slot 21 and a second threading slot 22 at two opposite ends outside the hitting pad 10. The hitting pad 10 can be formed in a circular shape. The two opposite ends of the holding board 20 are extended outwards to form respectively a first protrusive portion 201 and a second protrusive portion 202 to include respectively the first threading slot 21 and the second threading slot 22.

The two support pads 30 are located below the holding board 20 to form a housing groove 31 therebetween. The fastening band 40 threads through the first threading slot 21 and the second threading slot 22 via the-housing groove 31. The fastening band 40 is formed in a strip shape. The two support pads 30 are respectively formed in a semicircular shape and includes a straight edge 32 to border the housing groove 31. The two support pads 30 are spaced from each other at a distance greater than the width of the fastening band 40.

Figure 4:
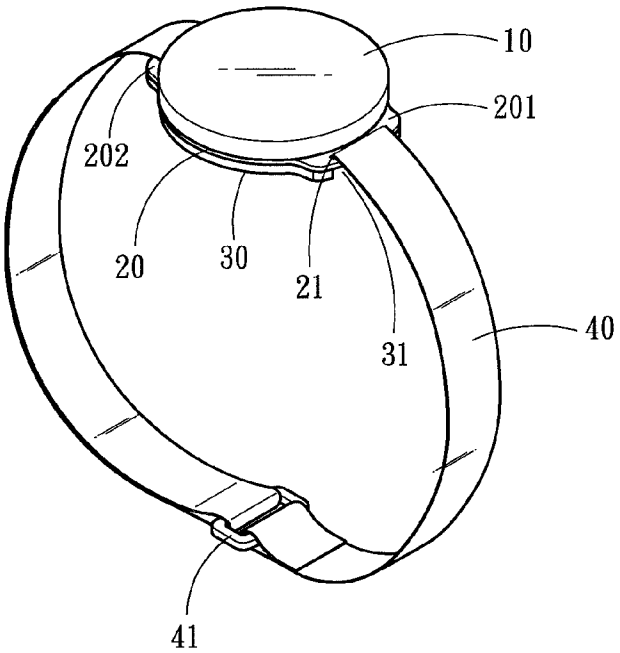
FIG. 4 is a schematic view of the fastening band of the invention in a use condition.

Please also refer to FIGS. 3 and 4, the two support pads 30 include respectively two bosses 301 corresponding to the first and second protrusive portions 201 and 202, thereby increase the contact area between the support pads 30 and holding board 20 to enhance stability. The fastening band 40 includes a buckle 41 at one end and a bonding portion 42 at another end which threads through the buckle 41 and folds inversely to bond to the fastening band 40.

Figure 5:
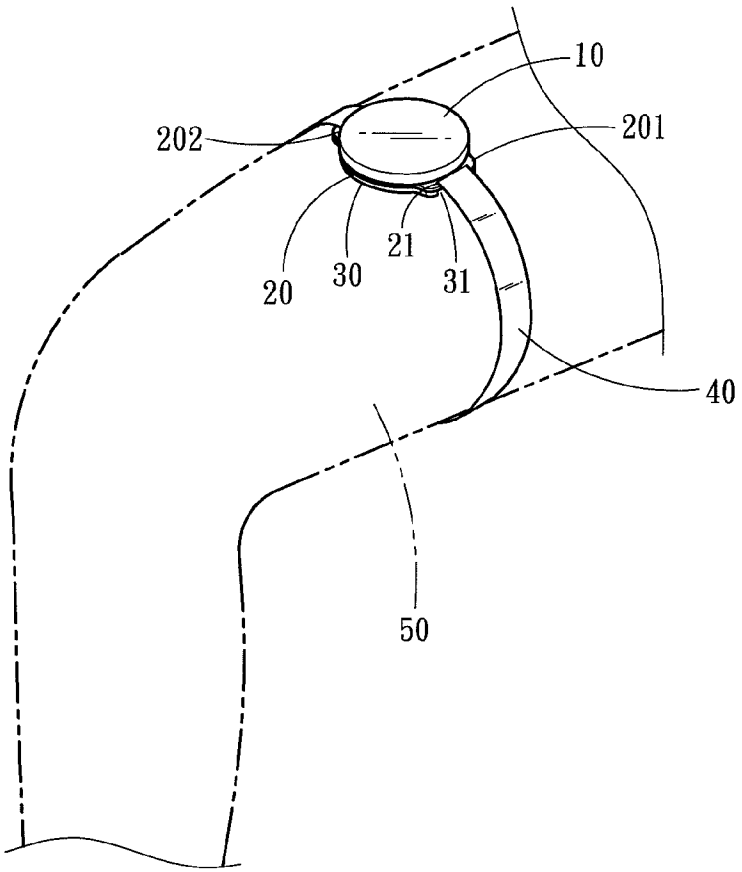
FIG. 5 is a schematic view of the invention in a first use condition.

Please refer to FIG. 5 for the invention in a first use condition. The user can select to wrap the fastening band 40 on the user's thigh 50 for hitting practice.

Figure 6:
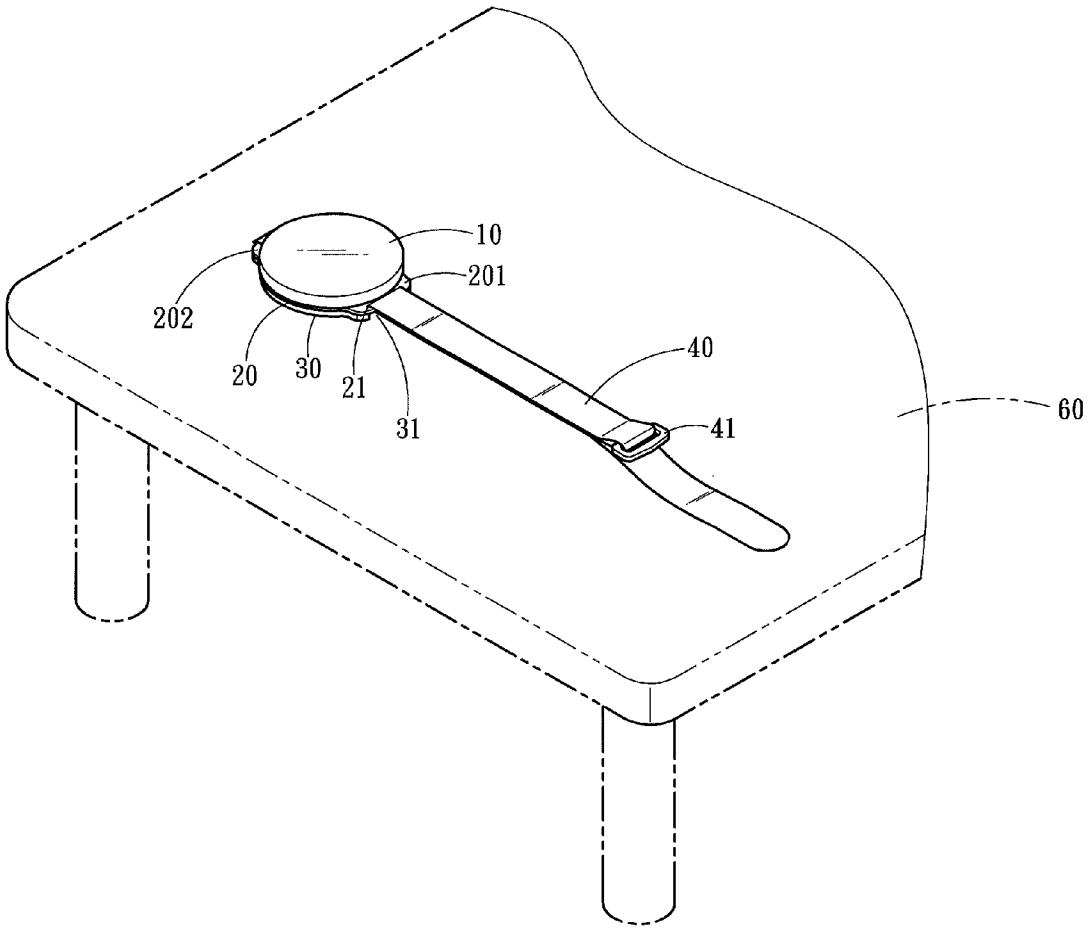
FIG. 6 is a schematic view of the invention in a second use condition.

FIG. 6 illustrates the invention in a second use condition. The user also can select to thread the fastening band 40 through the housing groove 31 and place the two support pads 30 stably on the desktop 60 to do hitting practice.

As a conclusion, the invention provides a dual-purpose practice instrument to meet requirements in different sites. Moreover, as the entire instrument of the invention is formed in a flat shape, it can be held in the user's pocket to be easily carried around, thereby meets use requirements.

What is claimed is:

1. A portable practice instrument, comprising:

a hitting pad;

a holding board which is located below the hitting pad and includes a first threading slot and a second threading slot formed respectively at two opposite ends thereof outside the hitting pad;

two support pads located below the holding board to form a housing groove therebetween; and a fastening band threading through the first threading slot and the second threading slot via the housing groove.

2. The portable practice instrument of claim 1, wherein the hitting pad is formed in a circular shape, the two opposite ends of the holding board being extended outwards to form respectively a first protrusive portion and a second protrusive portion to include respectively the first threading slot and the second threading slot.

3. The portable practice instrument of claim 2, wherein the fastening band is formed in a strip shape, the two support pads respectively being formed in a semicircular shape and including a straight edge to border the housing groove, the two support pads being spaced from each other at a distance greater than a width of a fastening band.

4. The portable practice instrument of claim 3, wherein the two support pads include respectively two bosses corresponding to the first protrusive portion and the second protrusive portion.

5. The portable practice instrument of claim 1, wherein the fastening band includes a buckle at one end and a bonding portion at another end which threads through the buckle and folds inversely to bond to the fastening band.

* * * * *